US006666139B2

(12) United States Patent
Göttling et al.

(10) Patent No.: US 6,666,139 B2
(45) Date of Patent: Dec. 23, 2003

(54) ARRANGEMENT FOR PROVIDING AND FEEDING TRANSFER MATERIAL FOR A THERMOGRAPHIC PROCESS FOR PRODUCING PRINTING PLATES ON A PLATE CYLINDER

(75) Inventors: Josef Göttling, Friedberg (DE); Thomas Hartmann, Friedberg (DE); Franz Weissgärber, Augsburg (DE)

(73) Assignee: MAN Roland Druckmaschinen AG, Offenbach am Main (DE)

( * ) Notice: Subject to any disclaimer, the term of this patent is extended or adjusted under 35 U.S.C. 154(b) by 83 days.

(21) Appl. No.: 09/853,368

(22) Filed: May 11, 2001

(65) Prior Publication Data

US 2002/0000170 A1 Jan. 3, 2002

(30) Foreign Application Priority Data

May 12, 2000 (DE) ..... 100 23 320

(51) Int. Cl.[7] ..... B41J 1/58

(52) U.S. Cl. ..... 101/483; 101/463.1; 101/467; 430/300; 430/306

(58) Field of Search ..... 101/467, 483, 101/401.1, 463.1, 469; 430/501, 300, 306

(56) References Cited

U.S. PATENT DOCUMENTS 3,780,214 A * 12/1973 Bestenreiner et al. ..... 358/503
5,094,933 A * 3/1992 Uhrig ..... 430/300
5,601,022 A 2/1997 Dauer et al. ..... 101/467

FOREIGN PATENT DOCUMENTS

DE 198 11 030 9/1999

* cited by examiner

*Primary Examiner*—Craig Hallacher
(74) *Attorney, Agent, or Firm*—Cohen, Pontani, Lieberman & Pavane

(57) ABSTRACT

A first structural unit includes a laser image-setting head, and a second structural unit includes a loading compartment to accommodate a cassette housing having a thermal transfer ribbon on spools having hubs. After a cassette is inserted in the loading compartment, the compartment is closed so that drive rollers engage the hubs without play. To produce a printing plate, the second structural unit is then brought over the first structural unit in the manner of a telescope by a moving device, and the thermal transfer ribbon is brought to the laser image-setting head. The thermal transfer ribbon inserted into the loading compartment is guided by self-centering means so that it does not contact the cassette housing, and is positioned with respect to the plate cylinder by guide rollers. Wear-free and therefore fast ribbon guidance can be performed, and automation of the movement sequences of the thermal transfer ribbon can be achieved.

17 Claims, 5 Drawing Sheets

ARRANGEMENT FOR PROVIDING AND FEEDING TRANSFER MATERIAL FOR A THERMOGRAPHIC PROCESS FOR PRODUCING PRINTING PLATES ON A PLATE CYLINDER

BACKGROUND OF THE INVENTION

1. Field of the Invention

The invention relates to an arrangement for providing and feeding transfer material for a thermographic process for producing printing plates on a plate cylinder. The arrangement includes a laser image-setting head which can interact with a thermal transfer ribbon, and means for guiding and positioning the thermal transfer ribbon with respect to the plate cylinder. The laser image-setting head and thermal transfer ribbon can be moved along the plate cylinder by a traversing unit.

2. Description of the Related Art

U.S. Pat. No. 5,601,022 discloses such an arrangement for providing and feeding transfer material for a thermographic process for producing printing plates, that is to say for setting an image on a printing plate in the printing machine. An image-setting system of this type for digitally written and re-erasable offset printing plates operates on the external drum principle, a narrow ink ribbon, similar to a typewriter ink ribbon, being lead past the rapidly rotating printing cylinder while a laser beam transfers the layer from the ink ribbon to the printing cylinder by means of heat. This produces the ink-carrying parts of the image.

Changing from one job to the next is a three-stage process: image-setting, fixing and image removal (erasure). The most important components of the image-setting procedure are the laser image-setting head, the thermal transfer ribbon and the plate cylinder.

The laser image-setting head receives the digital image data from the control desk. The polymer-coated thermal transfer ribbon is brought into close contact with the surface of the plate cylinder, which is preferably constructed as a printing sleeve. The laser image-setting head, with up to more than 200 channels, heats the thermal transfer ribbon pixel by pixel in accordance with the image information to be transferred. The laser and ribbon move transversely over the plate cylinder and therefore, in a spiral or helix, produce the printing image on the surface of the plate cylinder with high resolution.

The polymer applied is generally ink-carrying, the naked cylinder surface, that is to say the naked sleeve, is water-carrying.

As already shown by DE 198 11 031 A1, the thermal transfer ribbon is preferably located in an easily interchangeable cassette housing. After the passage of a complete track length, the ribbon is wound back and, if necessary, a further, unused track can be set up toward the laser image-setting head, so that a further image-setting process can be carried out. When such cassette housings are used, friction generally occurs between the thermal transfer ribbon and guide parts belonging to the cassette housing, so that, firstly, only limited ribbon speeds are possible and, in addition, the ribbon itself wears, or the functional layer is damaged.

In addition, the previously disclosed arrangement, referred to below as a ribbon station, is also restricted to setting the ribbon on and off with respect to the plate cylinder, and in this way only offers wear-afflicted ribbon guidance, depending on the cassette housing provided.

SUMMARY OF THE INVENTION

It is therefore an object of the invention to develop a generic arrangement, that is to say a ribbon station, in such a way that wear-free and therefore fast ribbon guidance can be performed and, after accommodating a cassette housing suitable for it, together with the thermal transfer ribbon ready prepared therein, the ribbon station permits the automation of the movement sequences for producing a printing plate on a plate cylinder.

The intention, therefore, is to apply a more developed cassette housing, in which the specially prepared thermal transfer ribbon can be transported in a manner completely decoupled from the cassette housing, as described in DE 100 23 319, to which U.S. application Ser. No. 09/851,919 filed on May 9, 2001 corresponds. This U.S. application is incorporated herein by reference.

Provided on the side faces of the cassette housing described there are holes, through which the hubs of the spools, that is to say at least one unwind and one winding roller, project from the housing. These hubs have one or more grooves to connect them firmly to suitable drivers so as to rotate therewith. The hubs have play within the holes, so that they can be positioned freely in the radial direction with respect to the housing.

It is viewed as particularly advantageous that the cassette housing does not have to have any ribbon guiding function and can therefore be constructed particularly simply. Neither bearings for the spools nor ribbon guide rollers are provided in the cassette housing instead, a transport safeguard is provided which prevents inadvertent unwinding but permits the thermal transfer ribbon to be wound in order to tension it, is preferably an integral constituent of the cassette housing and can be released both manually and under automatic control.

The object set above is achieved in a generic arrangement for providing and feeding transfer material for a thermographic process for producing printing plates on a plate cylinder. The invention provides a first structural unit, which comprises the laser image-setting head, and a second structural unit, which comprises a loading compartment to accommodate the thermal transfer ribbon, specially prepared in the cassette housing. Means for guiding and positioning the ribbon are motor-driven and designed to be self-centering, in such a way that to produce a printing plate, the second structural unit can be brought over the first structural unit in the manner of a telescope by means of a moving device, and therefore the thermal transfer ribbon can be brought to the laser image-setting head, and can be positioned freely to accommodate the thermal transfer ribbon. The thermal transfer ribbon inserted into the loading compartment can be guided without contact with respect to the cassette housing by the self-centering means and, to produce a printing plate, can be positioned with respect to the plate cylinder.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

DETAILED DESCRIPTION OF THE PRESENTLY PREFERRED EMBODIMENTS

Figure 1:
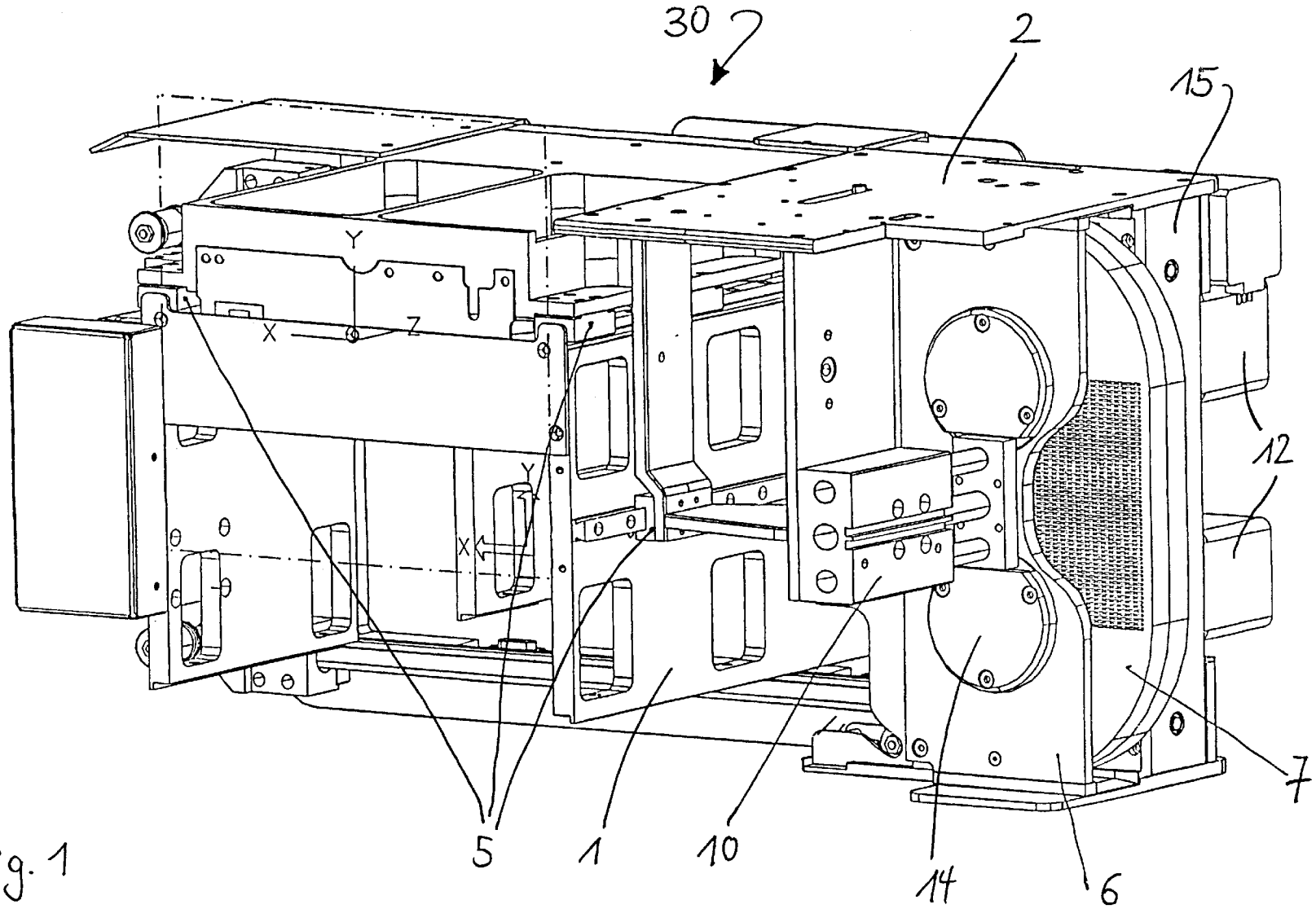
FIG. 1 shows a perspective view of the ribbon station according to the invention with its two structural units, which can be moved in the manner of a telescope, in the image-setting position.
Figure 5:
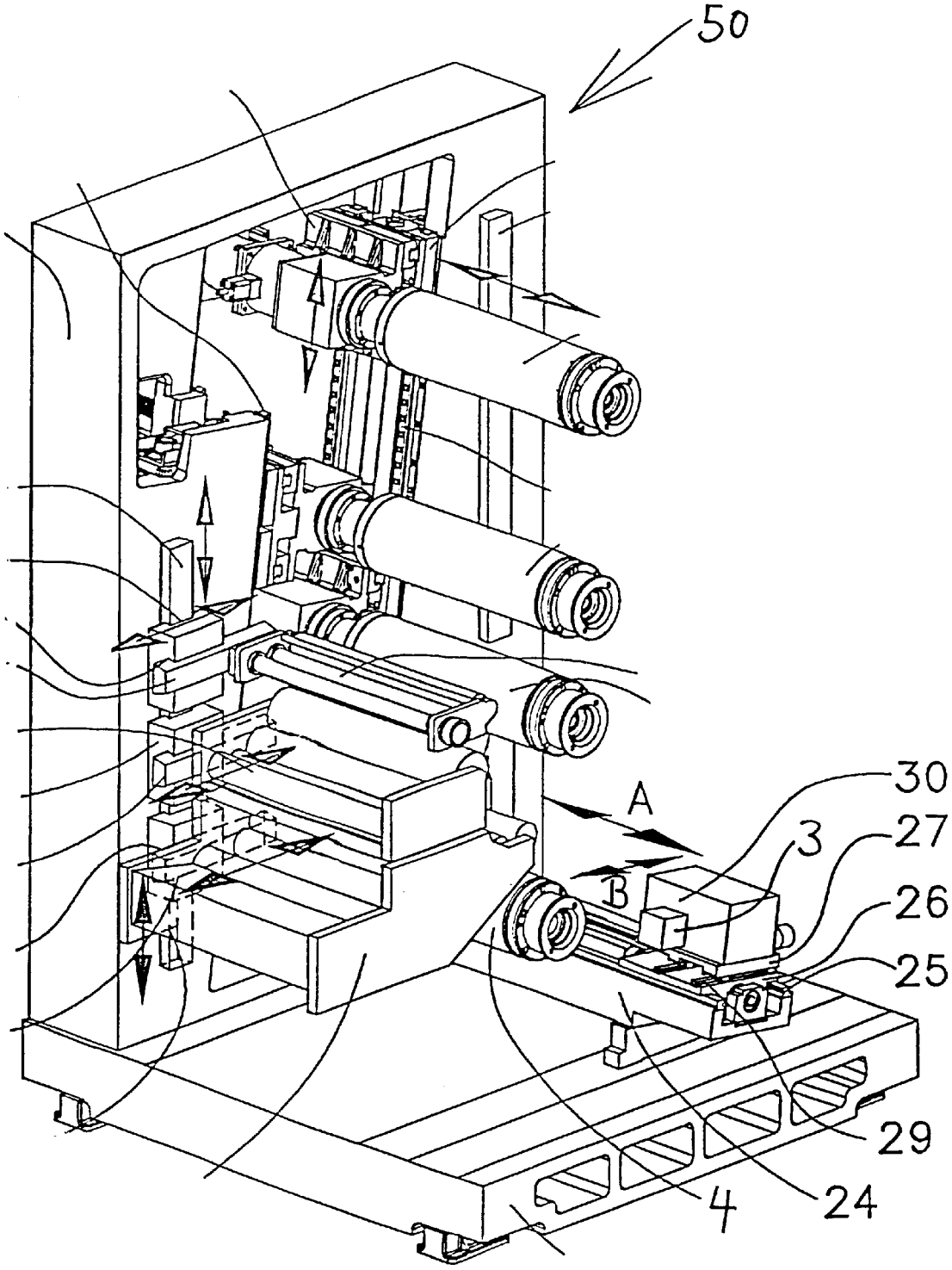
FIG. 5 shows a ribbon station according to the invention, built into an exemplary printing unit, likewise in a perspective view.

FIG. 1 therefore shows an exemplary embodiment of the ribbon station 30 (FIG. 5) in the image-setting position, that is to say with the first structural unit 1 and the second structural unit 2 pushed over one another in a manner of a telescope. The first structural unit 1 comprises a laser image-setting head 3 (FIG. 5). The method of driving, the construction and the mode of action of a laser image-setting head emitting one or more laser beams are known per se and therefore do not require any specific explanation in the present connection.

The first structural unit 1 is fixed on a cross table 26 by means of a carriage 27 and is therefore arranged on a traversing unit 24 such that it can be moved in the direction of a plate cylinder 4. A traversing guide 25 permits the ribbon station 30 to move transversely, that is to say in the axial direction of or longitudinally with respect to the cylinder 4, and a ribbon station guide 29 belonging to the cross table 26 permits the movement to and fro in the direction of the cylinder 4 (FIG. 5).

Also arranged on the first structural unit 1 is a moving device 5, by means of which a second structural unit 2 can be moved coaxially in a controlled manner over the first structural unit 1.

The second structural unit 2 comprises a loading compartment 6 to accommodate the thermal transfer ribbon specially prepared in a cassette housing 7.

Figure 2:
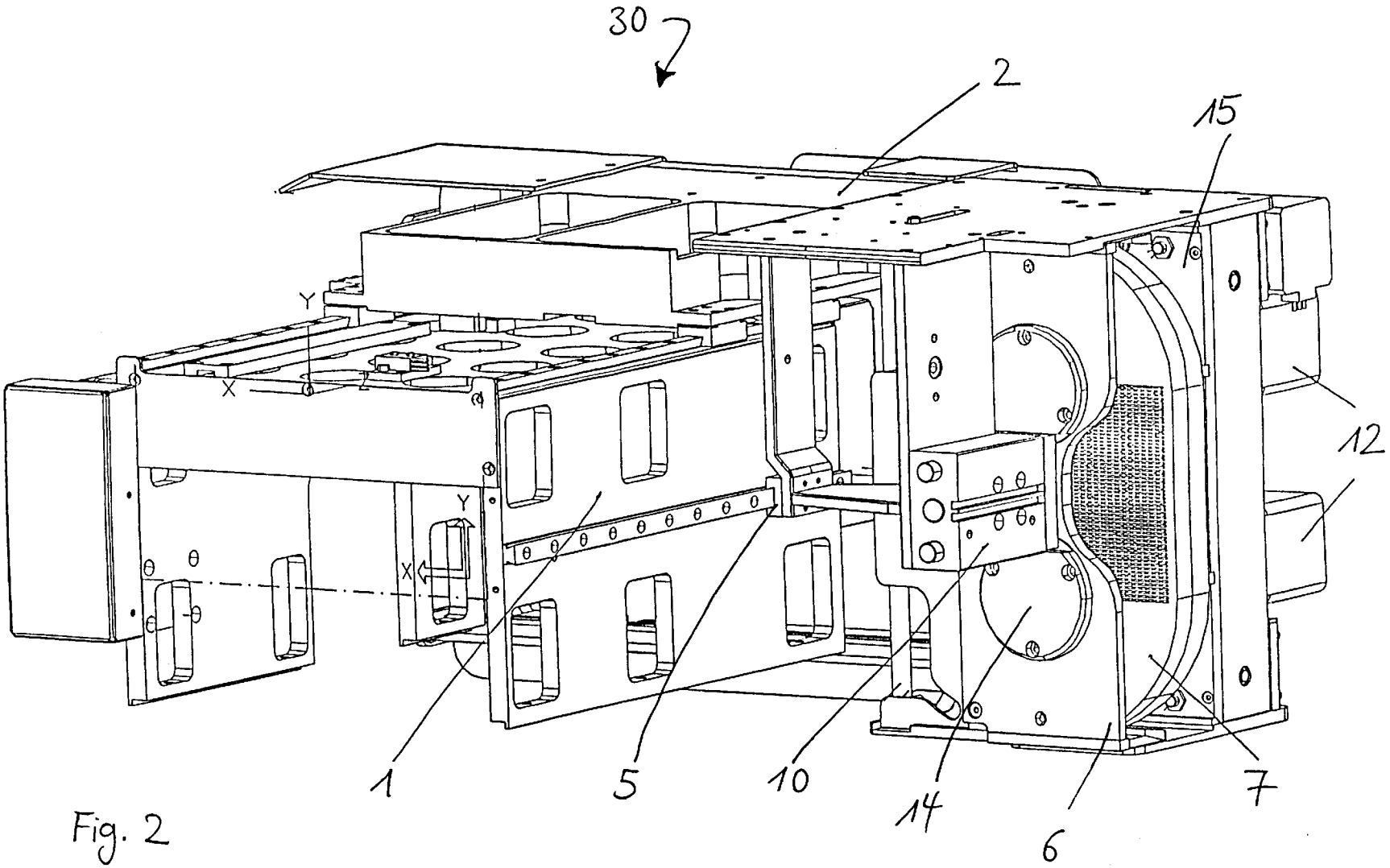
FIG. 2 shows the ribbon station according to FIG. 1 with the loading compartment open and inserted cassette in the cassette changing position.

FIG. 2 shows the ribbon station 30 in the state envisaged for the insertion of a cassette 7, in which state the second structural unit 2 with the loading compartment 6 has been moved out in the manner of a telescope from the first structural unit 1.

Figure 3:
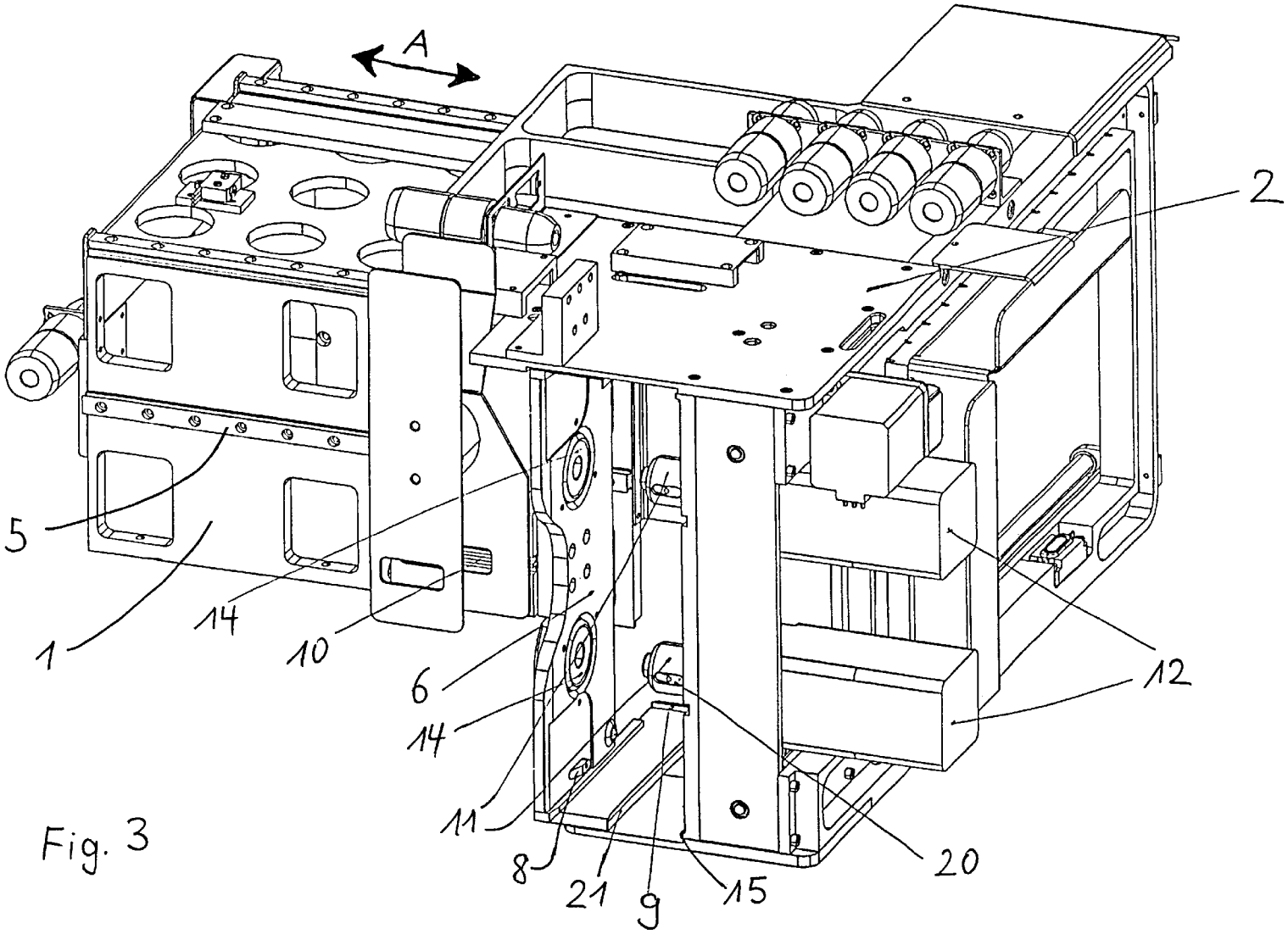
FIG. 3 shows the ribbon station according to FIG. 1 in the cassette changing position according to FIG. 2, without a cassette but from a perspective view rotated through about 45°.

According to FIG. 3, the ribbon station 30 is in the cassette changing position. To this end, the second structural unit 2 is in the position removed from the first structural unit 1.

The cassette housing 7 with the thermal transfer ribbon specially prepared therein is inserted manually into the loading compartment 6 by the machine operator in the exemplary embodiment illustrated, and is pushed in as far as the front stop 9, but automation of this loading operation is readily possible. At the same time, the cassette 7 is positioned in its vertical orientation by the loading compartment 6. As the cassette 7 is pushed in, the transport safeguards of the cassette 7 are already open on one side. This is made possible with the aid of chamfered keys 8. The loading compartment 6 is preferably closed by a pneumatic cylinder 10. Of course, closing the loading compartment by means of a spindle drive is also possible. During the closing procedure, the two hubs which are located in the cassette 7 are pushed onto two drivers 11 in the loading compartment 6, which are located on the motor shafts of the main drives 12 of the second structural unit 2. At the same time, the transport safeguard of the cassette 7 is opened completely. The two hubs are held in their axial position by means of a stop 13 (FIG. 4) on the respective driver 11 and a stop on the counter bearing 14. An O-ring is fitted to the counter bearing 14 as a sprung element in order to compensate for axial tolerances of the hubs. This ensures the clean, play-free positioning of the hubs in the axial direction. In order to avoid imbalances and to compensate for tolerances, the counter bearing 14 is centered in relation to the drivers 11.

The hubs are then positioned completely by the drivers 11 and have no contact at all with the cassette housing 7.

In the closed state, the loading compartment 6 rests with its side wall 21 close to the drivers 11 on a side wall 15 of the second structural unit. This achieves the situation where the closing force of the loading apparatus is not transmitted completely to the motor shafts, instead the force is introduced to the motor shafts only via the O-ring, and a major part is introduced directly into the side wall 15.

Figure 4:
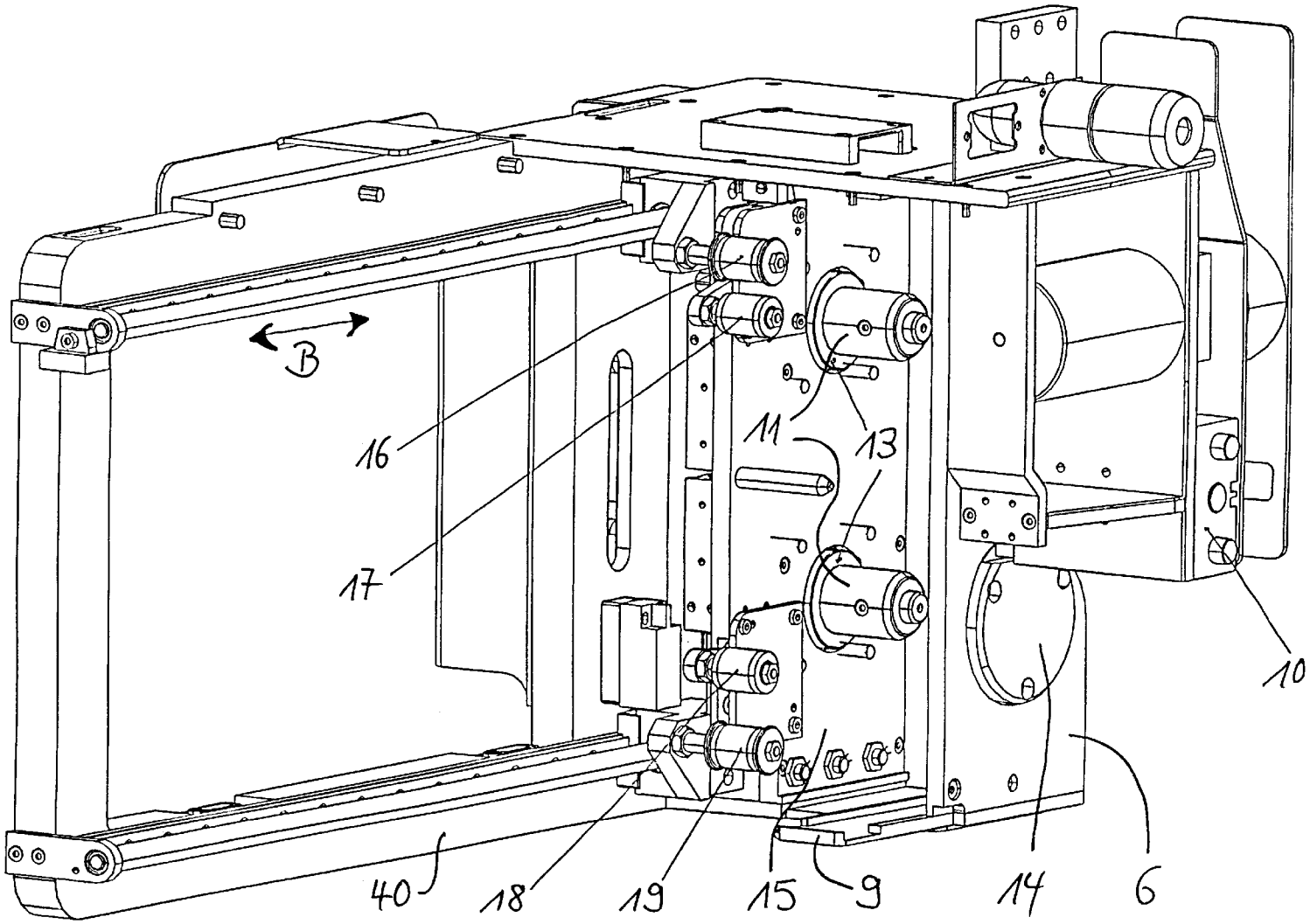
FIG. 4 shows a perspective view of the second structural unit of the ribbon station and its means for guiding and positioning the thermal transfer ribbon.

According to FIG. 4, all the guide rollers 16, 17, 18, 19 are located in the position needed for cassette changing, that is to say first guide rollers 16, 19 are in the position set against the loading compartment 6, and second guide rollers 17, 18 are pivoted toward each other. The loading compartment 6 is opened.

After the loading compartment 6 has been closed, the first guide rollers 16, 19 are moved outward in the direction B by a stepping motor and two threaded spindles, which are coupled via a toothed belt, and therefore pull the thermal transfer ribbon out of the cassette housing 7. The second guide rollers 17, 18 pivot away from each other into their operation position and take over the ribbon, and therefore its guidance in the cassette housing 7. After that, the ribbon is no longer in contact with the housing 7 and is positioned and guided solely by the elements 11, 16 to 19 of the ribbon station 30. During the entire movement operations, the thermal transfer ribbon is kept under tension with the aid of the drives, that is to say in particular by the main drives 12 of the second structural unit 2.

In order to bring the ribbon in front of the laser outlet, the second structural unit 2 moves over the first structural unit 1, along the direction of movement A, according to FIG. 3. Finally, the first guide rollers 16, 19 are moved a little further in the direction opposite to the direction of movement B until the mounting of the roller 16 triggers a reference switch, and therefore the starting position, that is to say precisely the reference position for an image-setting procedure, is reached.

The ribbon station 30 and the laser image-setting head 3 are located in the starting position for an image-setting procedure. Before the setting of an image starts, the thermal transfer ribbon is brought into close contact with the surface of the plate cylinder 4. This is carried out by the first guide rollers 16, 19 in the direction B from the starting position into the image-setting position. During the entire movement operations, the thermal transfer ribbon is kept under tension with the aid of the drives 12.

The close contact that has already been mentioned, that is to say smoothing the ribbon on the surface of the plate cylinder, is produced by means of the combination of the wrap angle of the ribbon on the cylinder and the ribbon tension applied by the drives 12. The wrap angle on the cylinder can be influenced by the selected end position of the guide rollers 16, 19. If the rollers 16, 19 are in their most forward position, the maximum possible wrap angle of the ribbon on the cylinder is achieved. The free choice of the front position of the rollers 16, 19 also permits format variability of various plate cylinders to be taken into account. In other words, it is therefore possible, given various cylinder diameters, for the wrap on the cylinder to be matched to the respective cylinder diameter.

In the periphery of each driver 11 there is a spring-mounted element, a key 20 chamfered on one side in the exemplary embodiment (FIG. 3). This makes it possible for the hub, which is provided with three grooves arranged symmetrically on the internal diameter, to be pushed onto the driver 11 in any desired position. If none of the grooves encounters the key 20, the latter is pressed into the driver, because of the spring mounting and the chamfer, and thus permits the hub to be pushed on. On the first occasion on which a drive force is applied to the drivers 11, the driver 11 moves in relation to the hub until the key 20 latches into one of the three grooves, and therefore a secured, form-fitting transfer of torque is ensured.

Shortly before the start of the image-setting procedure, the ribbon is accelerated to a constant speed, which is maintained by means of the drives 12 during the entire course of the image-setting procedure. This speed can be both higher and lower than the surface speed of the plate cylinder on which the image is to be set. This speed difference avoids the stick-slip effects which occur in the synchronous case.

After the image-setting procedure has been completed, the thermal transfer ribbon is braked and brought into the starting position for the next image-setting procedure. For this purpose, the ribbon is wound back and then displaced in the direction of movement A (FIG. 3) by at least or by somewhat more than one writing track width of the laser (about 1.6 mm). This procedure achieves the situation where a plurality of tracks can be written beside one another on one ribbon, and in the case of relatively small plate cylinder diameters, there is also the possibility of writing a number of image-setting procedures one after another in one track.

As soon as all the possible tracks on one cassette have been used, the cassette is changed. The sequence of steps is carried out in the opposite sequence to that during the cassette loading procedure.

The thermal transfer ribbon is held in its position by a self-centering system. The positioning and guidance of the ribbon are carried out with the aid of the first 16, 19 and second 17, 18 guide rollers. As a rule, convex rollers, such as are also known from the area of flat belt drives, are provided. In the preferred embodiment, the rollers 16 to 19 are designed as cylindrical rollers with a lateral chamfer. The advantage of this embodiment is a better centering action than that provided in the case of convex rollers, and a ribbon run which is better for the image-setting process, since the ribbon is impaired by the centering system only in its lateral regions but rests smoothly on the rollers in the central region.

One alternative to the chamfer in the edge region of the rollers 16 to 19 is provided by a small step in the region of the central outer periphery of the rollers 16 to 19. The quality of centering and the resulting centering force of the aforementioned rollers is a function of the wrap angle of the ribbon on an individual roller and of the ribbon tension. For this reason, attention is paid to the greatest possible wrap angle in the case of all the ribbon rollers.

Also provided is an additional apparatus for improving the smoothing of the thermal transfer ribbon onto the cylinder on which an image is to be set. This is needed in order to improve the quality of the transfer during the image-setting procedure, and to ensure close contact between ribbon and cylinder during the transfer as well.

In this case, this is a nozzle to which compressed air is applied and whose axis is aligned exactly with the operating point (focus point) of the laser during the transfer. In this case, care must be taken that the incident air jet only strikes the ribbon since otherwise the outflowing air could flow around under the ribbon, and considerable lifting of the ribbon off the cylinder can occur. The shape of the nozzle is preferably a circular opening, but it can also have any other shape. In the exemplary embodiment, the inflow direction is to be seen in the direction of the ribbon run, but can quite possibly also be oriented counter to the ribbon run.

The effect of this apparatus is that the ribbon basically has better contact with the cylinder. Furthermore, the outflow of the gas produced during the transfer is promoted, and the gas produced is compressed by the pressure on the ribbon, and therefore the distance between ribbon and cylinder is kept very small.

The lateral positioning and fixing of the cassette 7 within the loading compartment 6 is implemented by means of fixed and sprung contact pins, which act in pairs on the mutually opposite side surfaces of the cassette 7.

As a result of the interaction with the traversing unit 24, the thermal transfer ribbon can be moved over the width of the printing plate uniformly with the movement of the laser image-setting head 3. In a manner which is known and therefore not shown, all the rollers 16 to 19 can be driven directly or indirectly by means of electronically controllable motors, only the two drivers 11 being driven actively in the preferred exemplary embodiment shown, so that the ribbon tension can be kept constant during the transport of the ribbon.

The thermal transfer ribbon is stored in a cassette-like, transportable housing 7, one section of the ribbon extending between an unwind and a winding roller and the housing having, in this region, openings which permit the engagement of guide rollers 16 to 19. As a result, the ribbon can be kept undamaged to a greater extent than hitherto. A further advantageous effect which results is that an operator virtually no longer has to come into contact with the thermal transfer ribbon.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

We claim:

1. An apparatus for providing and feeding transfer material for a thermographic process for producing printing plates on a plate cylinder, said apparatus comprising a first structural unit comprising a laser image setting head which can interact with a thermal transfer ribbon to apply transfer material thereon to said printing plate on said cylinder, a second structural unit comprising a loading compartment to accommodate a cassette housing containing a thermal transfer ribbon on spools having hubs, means for positioning the thermal transfer ribbon with respect to said cassette housing, means for driving the spools, and means for centering the thermal transfer ribbon in said loading compartment without contacting said cassette housing, means for moving the second structural unit over the first structural unit so that said cassette can be loaded into said second structural unit and said thermal ribbon can be positioned with respect to said laser image setting head, and a traversing unit for moving said first structural unit along the plate cylinder so that an image can be transferred to said printing plate.

2. An apparatus as in claim 1 wherein the first structural unit is mounted on the traversing unit by a cross table which permits moving the first structural unit transversely to said plate cylinder.

3. An apparatus as in claim 1 wherein said second structural unit further comprises means for opening a transport safeguard of said cassette housing during insertion of said cassette into said loading compartment, said means for driving said spools comprising a pair of roller-like drivers which engage said hubs, said means for centering the thermal transfer ribbon comprising said roller-like drivers, said means for positioning the thermal transfer ribbon with respect to the housing comprising first guide rollers which can pull the thermal transfer ribbon out of the cassette housing and position the ribbon with respect to the plate cylinder, and second guide rollers which can engage the thermal transfer ribbon inside the cassette housing to guide the ribbon with contacting the housing during production of the printing plate.

4. An apparatus as in claim 3 wherein said roller-like drivers are motor driven, and only said roller-like drivers are motor driven.

5. An apparatus as in claim 3 wherein said roller-like drivers are motor driven, and one of said first and second guide rollers are motor driven.

6. An apparatus as in claim 3 wherein said roller-like drivers each comprise a spring element so that said hubs can be positioned without play on the drivers, and a stop which limits the axial travel of the hubs on the drivers, said loading compartment comprising a counter-bearing for each of the drivers.

7. An apparatus as in claim 6 wherein said loading compartment is movable out of said second structural unit to a loading position, and into said second structural unit to a closed position where said drivers engage said hubs, said loading compartment having a stop side which abuts an opposing wall of the second structural unit when the loading compartment is in the closed position.

8. An apparatus as in claim 3 further comprising stepping motors and intercoupled threaded spindles for moving said first guide rollers toward the plate cylinder to pull the thermal transfer ribbon out of the cassette housing, said second guide rollers being pivotable with respect to each other so that the thermal transfer ribbon can be kept under tension by the drivers during all movements.

9. An apparatus as in claim 3 further comprising a reference switch which is actuated by at least one of said guide rollers to indicate a starting position for imaging a printing plate.

10. An apparatus as in claim 8 further comprising a transverse guide for positioning said first guide rollers with respect to said plate cylinder so that format variability of the plate cylinder may be taken into account.

11. An apparatus as in claim 3 wherein said roller-like drivers each comprise a spring mounted element for adapting the driver to the hub to the respective hub.

12. An apparatus as in claim 11 wherein said spring mounted element comprises a chamfered key.

13. An apparatus as in claim 1 wherein, upon rewinding said ribbon after an image-setting procedure, said traversing unit can move said first and second structural units by at least one defined writing track width to a position where a plurality of tracks can be written beside one another on the thermal transfer ribbon.

14. An apparatus as in claim 3 wherein each of said first and second guide rollers is a cylindrical roller with lateral chamfering for self-centering ribbon guidance.

15. An apparatus as in claim 14 wherein each of said cylindrical rollers has a convex surface.

16. An apparatus as in claim 3 wherein each of said first and second guide rollers is a cylindrical roller having an outer surface with a central peripheral step for self-centering ribbon guidance.

17. An apparatus as claimed in claim 1 further comprising a compressed air nozzle aligned with the laser image setting head for smoothing the thermal transfer ribbon on to the plate cylinder.

* * * * *